United States Patent [19]

Buijs

[11] Patent Number: 4,539,788

[45] Date of Patent: Sep. 10, 1985

[54] METHOD OF BUILDING A HOUSE STARTING FROM A PACKAGED STRUCTURE, A PACKAGED STRUCTURE FOR USE IN SAID METHOD, A METHOD OF MAKING A FOUNDATION, AND A PILE CAP FOR USE THEREIN

[75] Inventor: Johannes Buijs, Krimpen a/d Ijssel, Netherlands

[73] Assignee: Adviesbureau D3BN Civiel Ingenieurs, Amsterdam, Netherlands

[21] Appl. No.: 491,060

[22] Filed: May 3, 1983

[30] Foreign Application Priority Data

May 13, 1982 [NL] Netherlands ..... 8201996

[51] Int. Cl.[3] ..... E04B 1/346

[52] U.S. Cl. ..... 52/745; 52/71

[58] Field of Search ..... 52/71, 747, 745, 236.8

[56] References Cited

U.S. PATENT DOCUMENTS

| | | | |
|---|---|---|---|
| 1,361,831 | 12/1920 | Crew | 52/281 |
| 3,494,092 | 2/1970 | Johnson et al. | 52/745 |
| 3,724,157 | 4/1973 | Miram | 52/745 |
| 3,785,095 | 1/1974 | Verner | 52/745 X |
| 3,921,362 | 11/1975 | Cortina | 52/745 |
| 4,170,852 | 10/1979 | Danis, Jr. | 52/71 |

FOREIGN PATENT DOCUMENTS

| | | | |
|---|---|---|---|
| 2064201 | 9/1971 | Fed. Rep. of Germany | 52/71 |

*Primary Examiner*—Carl D. Friedman

*Attorney, Agent, or Firm*—Winburn & Gray, Ltd.

[57] ABSTRACT

A method of building a house or the like on a previously provided foundation, starting from a packaged structure comprising a plurality of panels, wherein, after the deposition of the package on the foundation, in successive stages a superjacent part of the package is hoisted up, and in the space thus formed the panels are unfolded, and packaged structure for use in said method.

6 Claims, 7 Drawing Figures

METHOD OF BUILDING A HOUSE STARTING FROM A PACKAGED STRUCTURE, A PACKAGED STRUCTURE FOR USE IN SAID METHOD, A METHOD OF MAKING A FOUNDATION, AND A PILE CAP FOR USE THEREIN

This invention relates to a method of building a house or like building on a previously provided foundation, starting from a packaged structure comprising a plurality of panels.

In such methods, which are generally known, after the ground floor has been laid, the walls of the first storey are mounted thereon, possibly also one or more outer walls, whereafter the floor of the second storey is mounted. The next storeys and the roof storey are mounted in a similar manner.

It is an object of the present invention to rationalize the said method and to shorten the time required for the construction.

For this purpose the method according to the invention is characterized in that, after the deposition of the package on the foundation, in successive stages a superjacent part of the package is hoisted up, and in the space thus formed the panels are unfolded.

In one embodiment of the method according to the invention, for setting-up the roof storey, the roof panels, which are hinged together and situated at the top of the package, are moved upwards, and secured by means of coupling members at their edges opposite said hinge to a roof-storey floor, whereafter an outer wall member, which in the packaged form is intermediate the roof panels and the roof-storey floor, is unfolded. As the roof panels are raised further, walls hinged to the roof-storey floor are unfolded and, arrived in their vertical position, are coupled at their edges opposite said hinges to a storey floor. By subsequently unfolding an outer wall element, which in the packaged position lies on said storey floor, a storey is completed.

It will be clear that, starting from one or more standardized construction packages or building units, a plurality of such units can be arranged next to each other for them to jointly form a house or like building. In such a method, the next construction unit, after being assembled, is in each case secured to the preceding, already assembled construction unit.

In another aspect of the present invention, there is provided a packaged structure comprising, in closely packed condition, and in succession, two hinged-together roof panels, an outer wall element hinged to a subjacent roof-storey floor, walls hinged to said roof-storey floor, and a second outer wall element hinged to a storey floor. In such packaged structure, the storey floor may be hinged to two subjacent walls, under which is provided a next outer wall element, which is hinged to a next storey floor. In order that the assembled building units may be centered relatively to each other, one or more panels may be provided with guide grooves at edges which are free edges in the assembled condition.

The invention further relates to a method of making a foundation, which comprises securing a pile cap to each pile with adjustment in both horizontal and vertical direction by means of swelling grout or like material, and thereafter positioning foundation beams or like horizontal members each on two or more pile caps with insertion of grout for adjusting purposes.

The invention finally also relates to a pile cap comprising a body that is closed all round and centrally provided with a recess arranged to receive the upper end of a pile with clearance.

One embodiment of the method of building a house, starting from a packaged structure, and also of the packaged structure, and the foundation will now be described with reference to the accompanying drawings. In said drawings.

Figure 1:
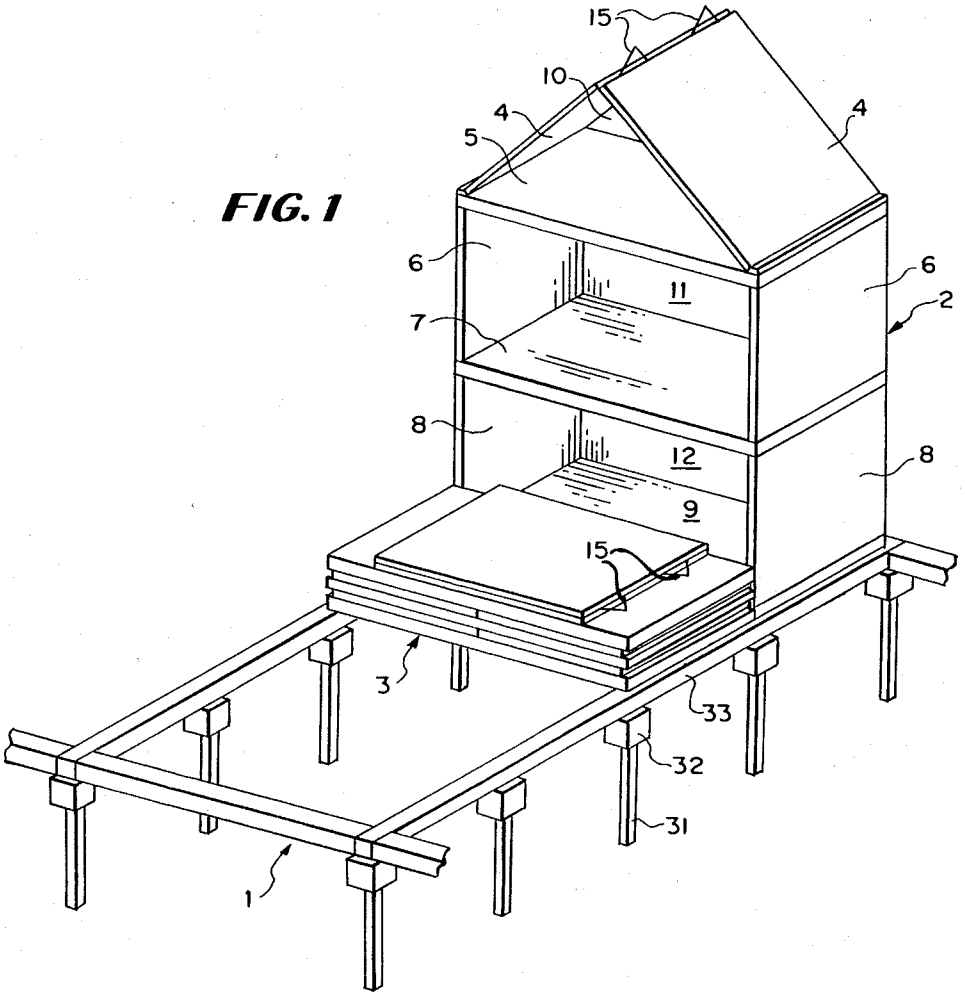
FIG. 1 shows a perspective elevational view of a first packaged structure unfolded on a foundation, and a second packaged structure deposited on said foundation in front of the first structure.
Figure 2:
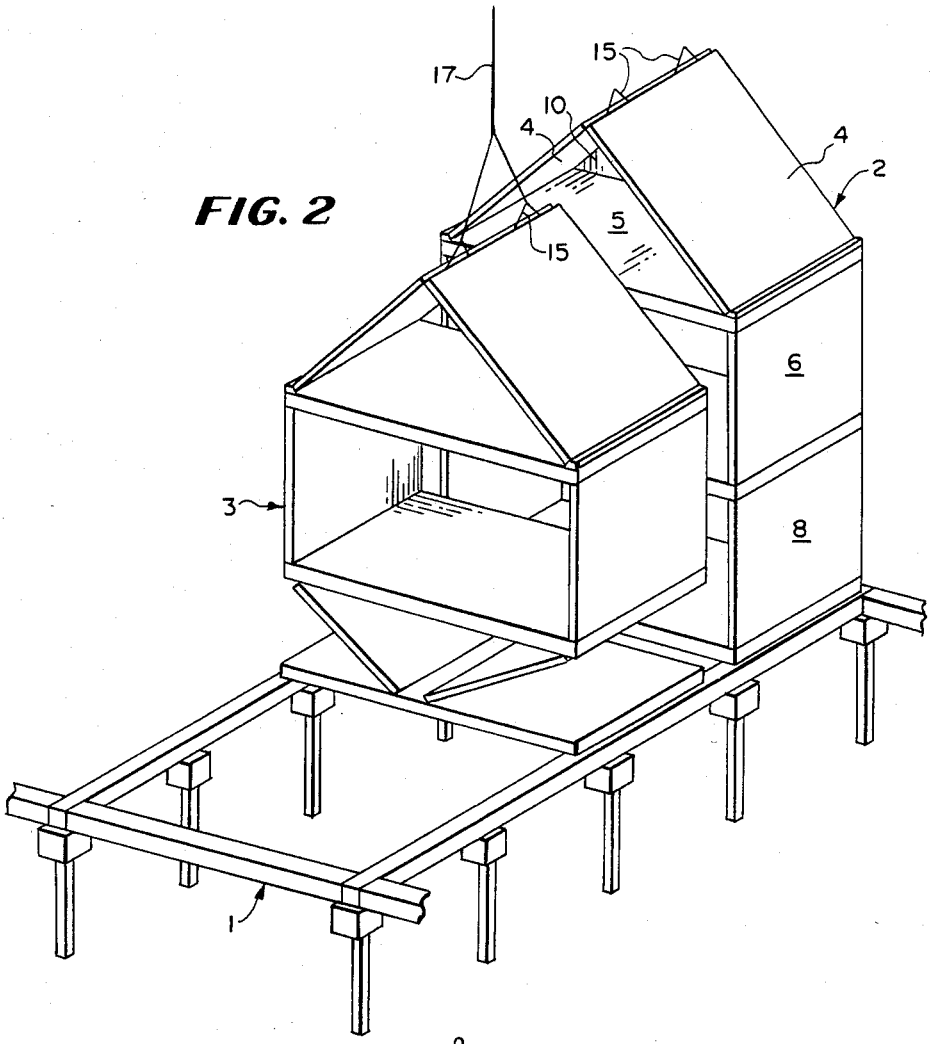
FIG. 2 shows an elevational view similar to FIG. 1, but showing the second packaged structure in partially erected position.
Figure 7:
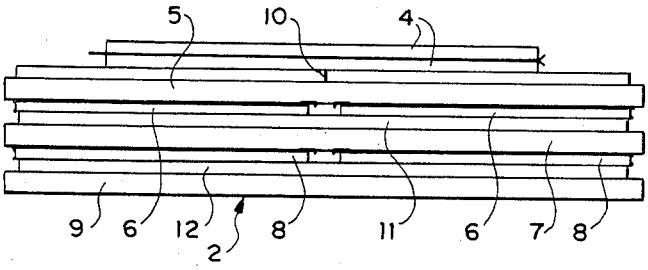
FIG. 7 is a front-elevational view of a package for erecting the end part of the house.

Referring to the drawings, in particular FIGS. 1 and 2, the hull of a house can be made by means of four construction packages deposited on a foundation 1. The first package 2 shown in front-elevational view in FIG. 7 is shown in FIGS. 1 and 2 in completely unfolded condition. The second package 3 is shown in FIG. 1 in the folded condition and in FIG. 2 in partially unfolded condition.

As shown in the drawings, the building package 2 comprises two roof panels 4, a roof-storey floor 5, wall panels 6, a storey floor 7, wall panels 8, and a ground floor 9, as well as a roof-storey outer wall 10, a storey outer wall 11 and a ground-floor outer wall 12. The package 2 thus described is suitable for forming an end portion of a house.

The panels may be of the kind commercially available under the name of stressed-skin panels, but other panels are of course also suitable.

The package 3 comprises in essence the same elements, except that the outer walls 10, 11 and 12 are lacking. In this way the package can serve as an intermediate section in building a house composed of three or more packages.

Figure 3:
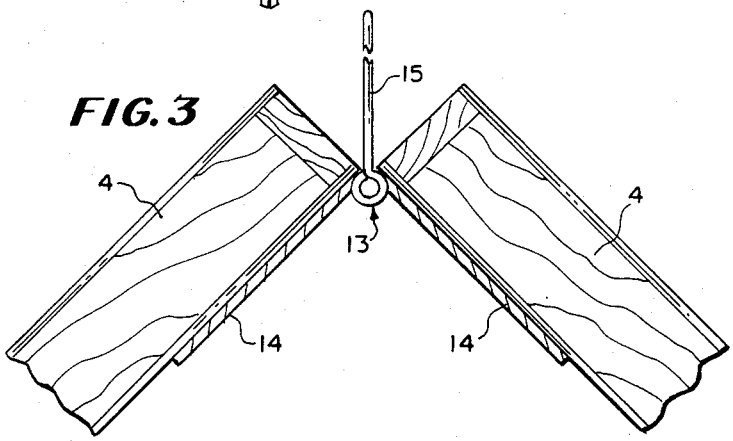
FIG. 3 is an enlarged view showing the connection between the two roof panels.

As best shown in FIG. 3, the two roof panels 4 are interconnected by hinges 13. The arms 14 of hinges 13 are fixedly connected to roof panels 4 by means not shown. The hinges further comprise eyelets 15 serving for connection with a hoisting rope 17 (see FIG. 2).

In erecting the package, hoisting rope 17, after being connected to eyelets 15, is raised, whereby the roof panels are moved upwards to the vertical position. The rope is then let out in order for the two panels to be moved apart at their free ends, for them to be connected by their free side edges to the subjacent roof-storey floor. When this connection has been made, the roof-storey outer wall is unfolded to give stability to the structure. The whole is then raised further, whereby wall panels 6 will move from their horizontal folded condition to the vertical condition. In the latter condition, wall panels 6 are secured to the storey floor 7, whereafter the storey floor outer wall 11 is moved from its horizontal into a vertical position. Thereafter the whole is raised further, whereby side wall panels 8 will move from the horizontal to the vertical position. The position occupied during this movement is shown in FIG. 2 (although with reference to package 3). When side wall panels 8 have reached the vertical position, they are fixedly connected to the ground floor 9, whereafter the ground floor outer wall 12 is moved from the horizontal into the vertical position.

When packages 2 and 3 have been erected, similar packages not shown may be erected for completing the hull of a house.

The connections used in the construction described will now be described in more detail.

Figure 4:
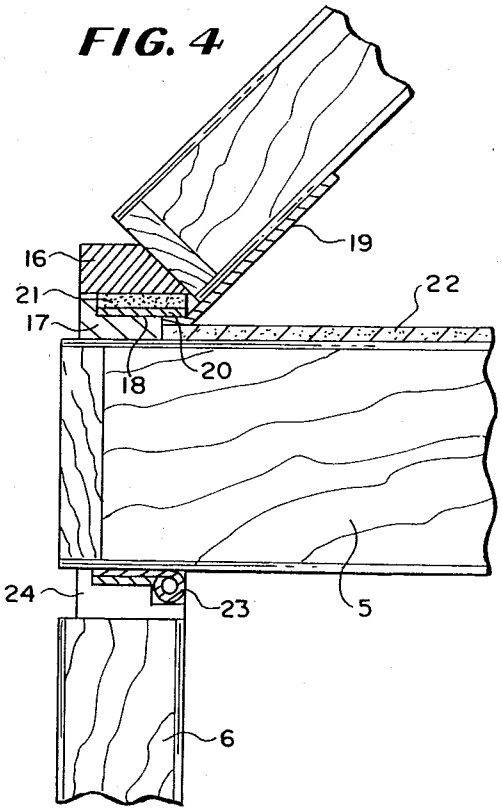
FIG. 4 is an enlarged view showing the connections between the roof panel and the roof-storey floor, as well as a wall panel.

FIG. 4 shows a wall plate 16, and an intermediate plate 17 with a recess 18. Secured to roof panel 4 is a metal plate 19, and a metal plate 20 is provided in recess 18. As shown, in the mounted condition a bent marginal portion of plate 19 extends under metal plate 20. Above the metal plate, a strip of insulating material 21 is provided.

Provided on the roof-storey floor 5 is also a layer of insulating material, here designated 22. The wall plate 16 and the insulating layer 21 directly under it, metal plate 20 and intermediate plate 17 may be jointly connected to floor 5.

The connection between each side wall panel 6 and floor 5 is constituted by a hinge 23, one leg of which is fixedly connected to floor 5 with the other leg being received in a recess of a panel end slat 24 provided on side wall panel 6.

Figure 5:
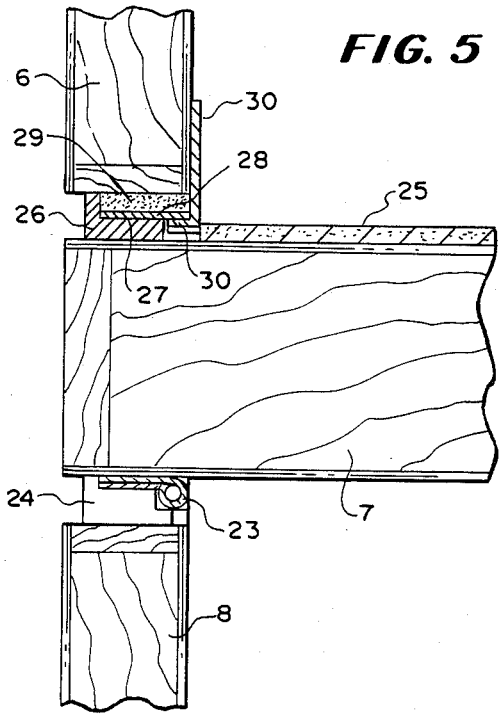
FIG. 5 is an enlarged view showing the connections between a storey floor and the adjacent wall panels.

FIG. 5, which shows the connection between side wall panels and a storey floor, shows similar connections to those shown in FIG. 4. On the storey floor, next to a layer of insulating material 25 a panel end slat 26 is provided, which is formed with a recess 27, in which a metal strip 28 is secured, covered with a strip 29 of synthetic plastics material. The lower end of side wall panel 6 is provided with a metal strip 30 having a bent end portion. During assembly the bent end portion 30 will come to be positioned just under metal strip 28 and be fixed therewith by tightening bolts not shown.

The connection between floor 7 and sidewall panel 8 is similar to that between floor 5 and panel 6, and is therefore designated by the same reference numerals.

As shown in FIGS. 1 and 2, the foundation 1 may consist of piles 31, each equipped with a pile cap 32, on which a plurality of concrete foundation beams 33 are positioned.

Figure 6:
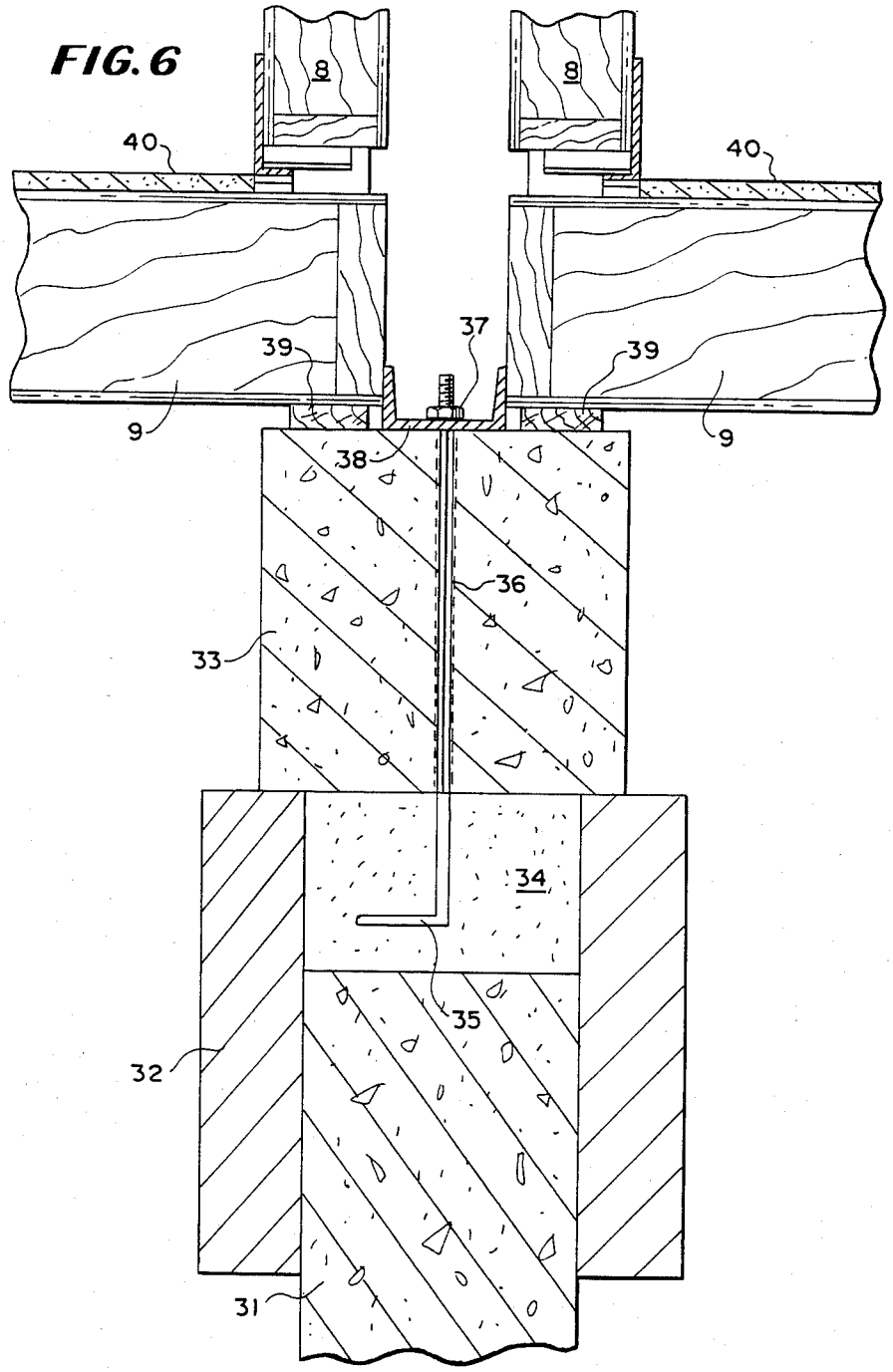
FIG. 6 is an enalarged view showing a portion of the foundation and the connection thereof to the ground floors and the walls.

The pile cap with the foundation beam thereon and the adjacent ground floors with wall panels is shown in greater detail in FIG. 6. As shown in this figure, the pile cap is in essence a rectangular, tubular element slipped over the upper end of pile 31. When the pile cap has been adjusted to the correct level, the space above the pile in the cap is filled with swelling grout 34 with an anchor bolt 35 embedded therein. Thereafter the foundation beam 33, which is provided with a passage way 36 for anchor bolt 35, is placed on the pile cap. Beam 33 is secured in place by means of a nut 37 with a spacer member 38 being interposed. Mounted on the foundation beam, in each case with interposition of a hardwood slat 39 (serving as a moisture barrier) are the ground floors 9. The ground floor 9 is provided at the top with an insulating layer 40. The connection between the ground floor and sidewall panel 8 is similar to that between the intermediate floor 7 and sidewall panel 6. The same parts are therefore designated by the same reference numerals.

It will be clear that a large number of variations is possible without departing from the scope of the invention. Thus, for example, instead of outer walls 10, 11 and 12, which serve for stabilizing purposes, use can be made of a separate well, first to be erected, for example, in the form of a so-called "wet cell", i.e. integrated washing and bathing facilities, whereafter packages 2 and 3 can be unfolded against it. Also the form of the roof can be changed. Further the connections between the several parts can be changed. The floors and panels can be provided with isolation etc.

It is further noted that, although the panels and floors are shown as closed elements, these are naturally provided with frames for receiving windows, doors etc.

The interior dimensions of the pile cap are such that it can be slipped over the upper end of the pile with clearance, so that it can be given the correct position relative to it before being fixed relative to the pile by means of grout. After the installation of the cap, a foundation beam is laid on two or more pile caps with grout 41 being interposed for the beam to bear uniformly on the caps.

What I claim is:

1. A method of building a house or the like on a previously provided foundation starting from a folded and stacked packaged structure including a plurality of panels including roof panels for forming a roof storey on said house, comprising:

permanently attaching at least some of said panels, including said roof panels, to one another with hinge means; depositing said package on said foundation;

moving said roof panels, which are situated at the top of the package, upwards, and securing said roof panels by means of coupling members at their edges opposite said hinge means to a roof-storey foor;

unfolding a roof storey outer wall member, which in the packaged form is intermediate the roof panels and the roof-storey floor; and successively hoisting up from superjacent to subjacent the remaining panels of said package such that said hingedly attached panels are unfolded into proper position and can be readily attached to the next subjacent portion of said package.

2. A method according to claim 2, characterized in that, as the roof panels are raised further, walls hinged to the roof-storey floor are unfolded and, arrived in their vertical position, are coupled at their edges opposite said hinges to a storey floor.

3. A method according to claim 3, characterized by subsequently unfolding an outer wall element which in the packaged position lies on said storey floor.

4. A method according to claim 2, starting from more than one adjacent construction packages or units, characterized in that the next construction unit, after being assembled, is in each case secured to the preceding, already assembled construction unit.

5. A packaged structure comprising, in closely stacked condition, and in succession from top to bottom, two hinged-together roof panels, an outer wall element permanently hinged to a subjacent roof-storey floor, two walls permanently hinged to said roof-storey floor, a second outer wall element permanently hinged to a storey floor where said storey floor is hinged to two subjacent walls, under which is provided a next outer wall element, which is hinged to a next storey floor.

6. A packaged structure according to claim 5, characterized in that one or more panels are provided with guide grooves at edges which are initially free edges when said packaged structure is in the assembled and unfolded condition.

* * * * *